United States Patent [19]

Kimura

[11] 4,133,278

[45] Jan. 9, 1979

[54] TOY KNITTING DEVICE

[75] Inventor: Osamu Kimura, Tokyo, Japan

[73] Assignee: Tomy Kogyo Co., Inc., Japan

[21] Appl. No.: 743,036

[22] Filed: Nov. 18, 1976

[51] Int. Cl.[2] ..... D05C 15/14

[52] U.S. Cl. ..... 112/198; 66/1 R; 66/85 R; 112/199; 112/203

[58] Field of Search ..... 112/198, 199, 202, 203, 112/204, 47, 78, 82, 102; 66/1 R, 1 A, 85 R, 85 A, 203

[56] References Cited

U.S. PATENT DOCUMENTS

| | | | |
|---|---|---|---|
| 1,684,004 | 9/1928 | Becker | 112/199 |
| 2,560,100 | 7/1951 | Ginsberg | 112/199 |
| 2,796,034 | 6/1957 | Bihaly | 112/204 |
| 2,895,439 | 7/1959 | Lipfert | 112/204 |
| 2,935,862 | 5/1960 | Jette | 66/1 R |
| 2,939,414 | 6/1960 | Slinn | 112/204 |
| 3,099,973 | 8/1963 | Lees | 112/199 |
| 3,182,619 | 5/1965 | Sally | 112/203 |
| 3,406,540 | 10/1968 | Dancygier | 66/85 R |
| 3,701,461 | 10/1972 | Bailly | 112/198 X |

*Primary Examiner*—Werner H. Schroeder
*Assistant Examiner*—Moshe I. Cohen
*Attorney, Agent, or Firm*—Staas & Halsey

[57] ABSTRACT

An amusement device for looping yarn onto a flexible plastic framework consisting of a housing provided with a platform and a rotatably mounted handle, an advancing mechanism for sequentially gripping the frame and moving same forwardly along the platform, a needle operable in conjunction with a cam-like mechanism for rotating and reciprocating the needle in a predetermined sequence to progressively loop yarn along rows of filaments within the frame, a mechanical interface for operating both the feed mechanism and the needle in response to rotation of the handle, and a guide mechanism for moving the frame along the platform to permit knitting along a different row of filaments of the frame.

8 Claims, 11 Drawing Figures

FIG. 3
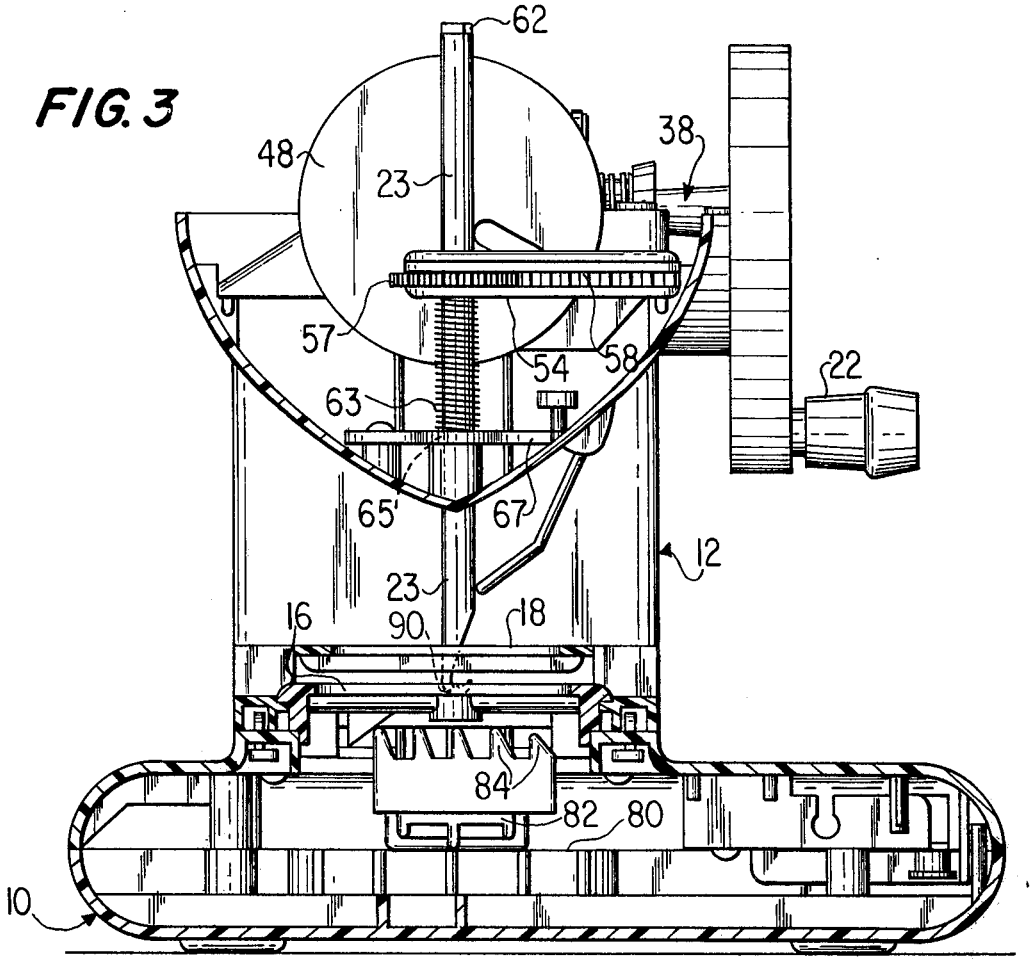
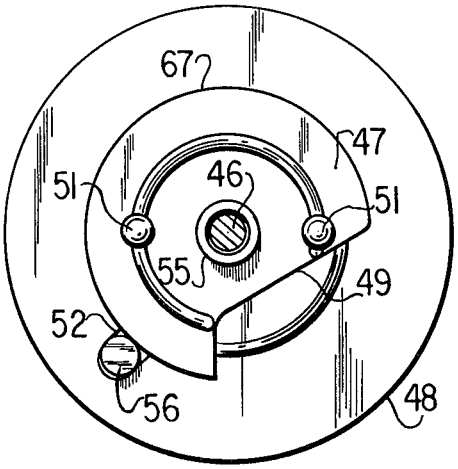
FIG. 7

TOY KNITTING DEVICE

BACKGROUND AND SUMMARY OF THE INVENTION

The present invention relates to a toy knitting device, and in particular to a machine wherein the single act of rotating a wheel is responsible for operating in appropriate sequence both an oscillating feed mechanism for advancing a flexible plastic framework onto which the yarn is looped and a reciprocating and rotating needle mechanism which is provided with a hook-end which continuously forms loops of yarn on the flexible plastic framework, after which by movement of a guide mechanism the plastic framework is moved transversely across the platform of the machine such that the yarn may be looped on different rows of filaments along the framwork.

BRIEF DESCRIPTION OF THE DRAWINGS

FIG. 3 is a sectional view taken along line 3—3 of FIG. 2 illustrating in particular the mounting of the needle and the rotating disc which is provided with a cut-out cam surface which is responsible for rotating and reciprocating the needle in a predetermined sequence;

FIG. 7 is a sectional view taken along the line 7—7 of FIG. 2 illustrating in particular the generally circular peripheral surface of the plate mechanism and the cut-out cam surface associated therewith which is responsible for guiding the motion of the needle;

Figure 1:
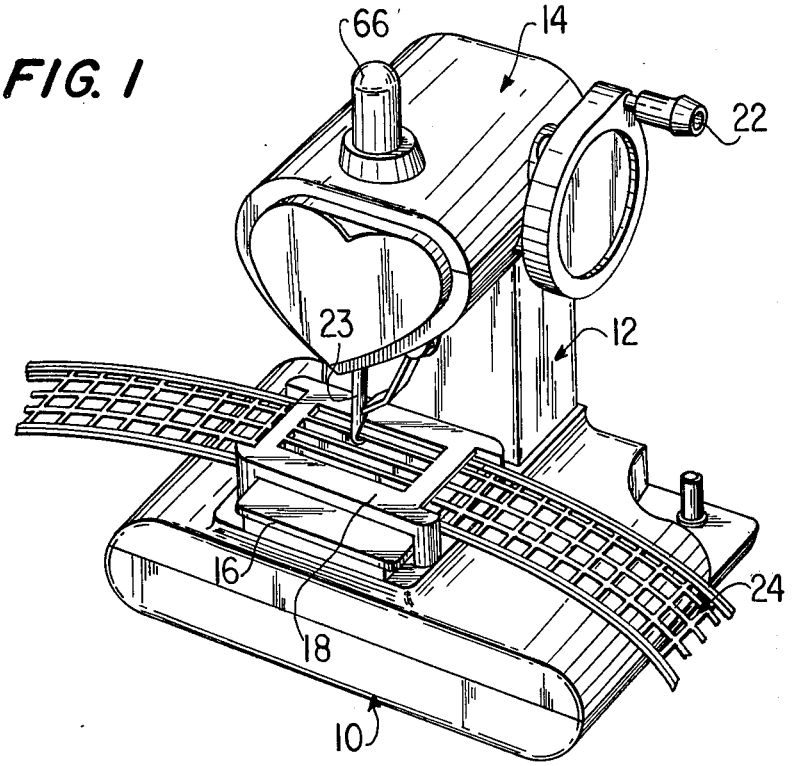
FIG. 1 is a perspective view of the toy knitting device of the present invention illustrating in particular the passage of the flexible knitting framework between the platform of the machine and the guide mechanism.

DESCRIPTION OF THE PREFERRED EMBODIMENT:

The toy knitting machine of the present invention, as generally illustrated in FIG. 1, includes a base 10, a support section 12 and a head 14. The base 10 is provided with a platform 16 over which a guide member designated by the reference numeral 18 is slidably mounted. Extending downwardly from the head 14, and mounted to both reciprocate and rotate with respect to the head 14, is an elongated needle 23. The head 14 is also provided with a handle 22 extending outwardly therefrom and which is mounted to be rotated by the child. Finally, the flexible, plastic knitting framework to be described hereinafter, designated by the reference numeral 24, passes between the platform 16 of the base 10 and the guide member 18, as seen in FIG. 1.

Figure 6:
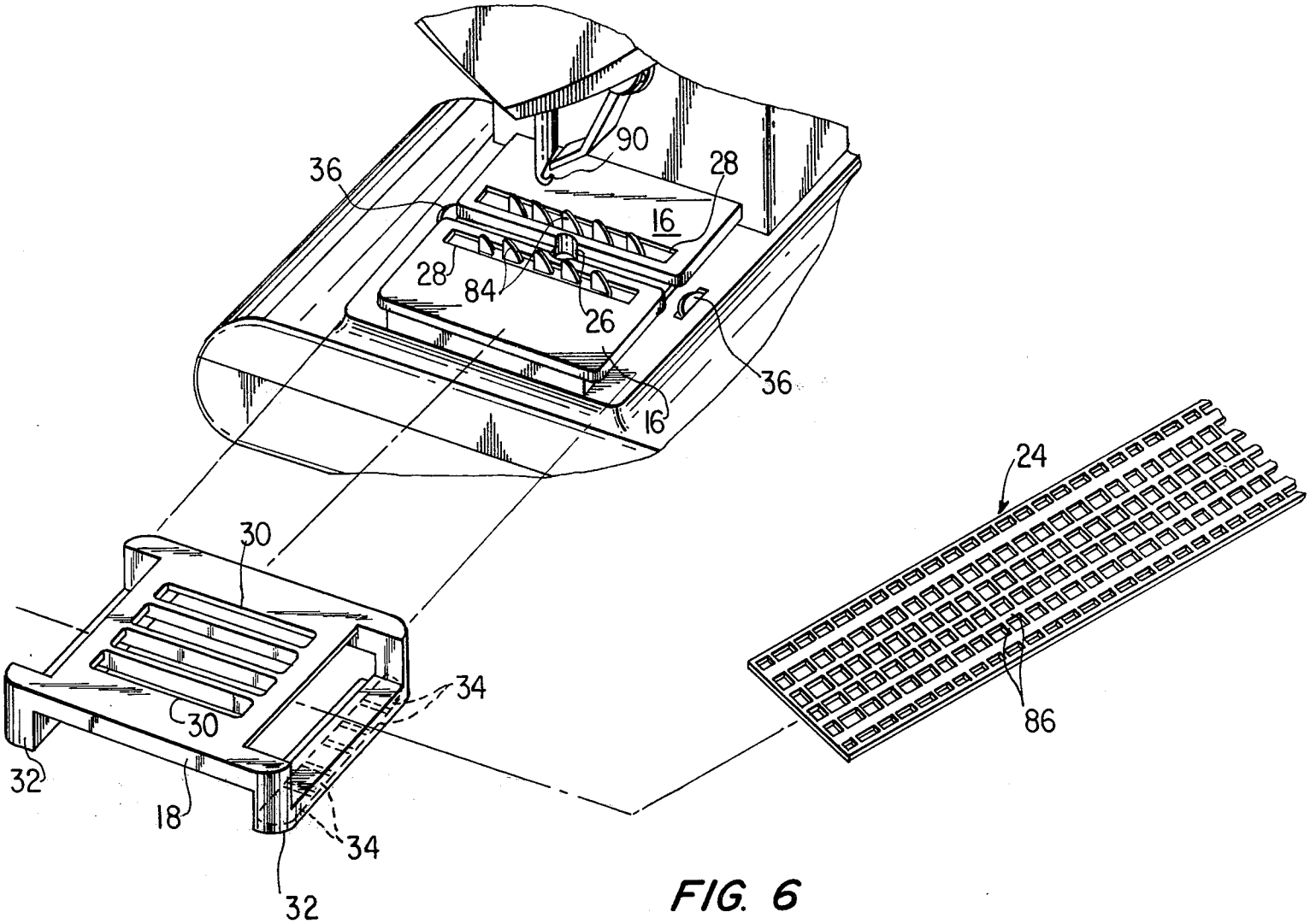
FIG. 6 is an exploded perspective view of a portion of the knitting machine illustrating in particular the construction and relationship of the platform of the base of the machine and the guide member through which the flexible knitting framework extends, and which may be advanced transversely across the platform in increments to permit knitting along different rows of filaments along the framework.

From FIG. 6, it will be apparent that the platform 16 of the base 10 is provided with an opening 26 through which the needle 23 passes when in its fully extended position, and two longitudinal slots 28. The guide member 18 is similarly provided with four slots 30 which are spaced apart such that alternating pairs of the slots 30 correspond to the slots 28 within the platform 16 of the base 10. The legs 32 of the guide member 18 are provided along the bottom surfaces thereof with small cavities 34 which, as illustrated in dotted lines in FIG. 6, are of a width corresponding to the width of the slots 28 and 30. Suitably mounted for rotation to the platform 16 are wheels 36 which fit within the cavities 34 such that the guide member 18 may be moved transversely across the platform 16 in predetermined increments which correspond to the width of the slots 28 within the platform 16 and the slots 30 within the guide member 18.

Figure 2:
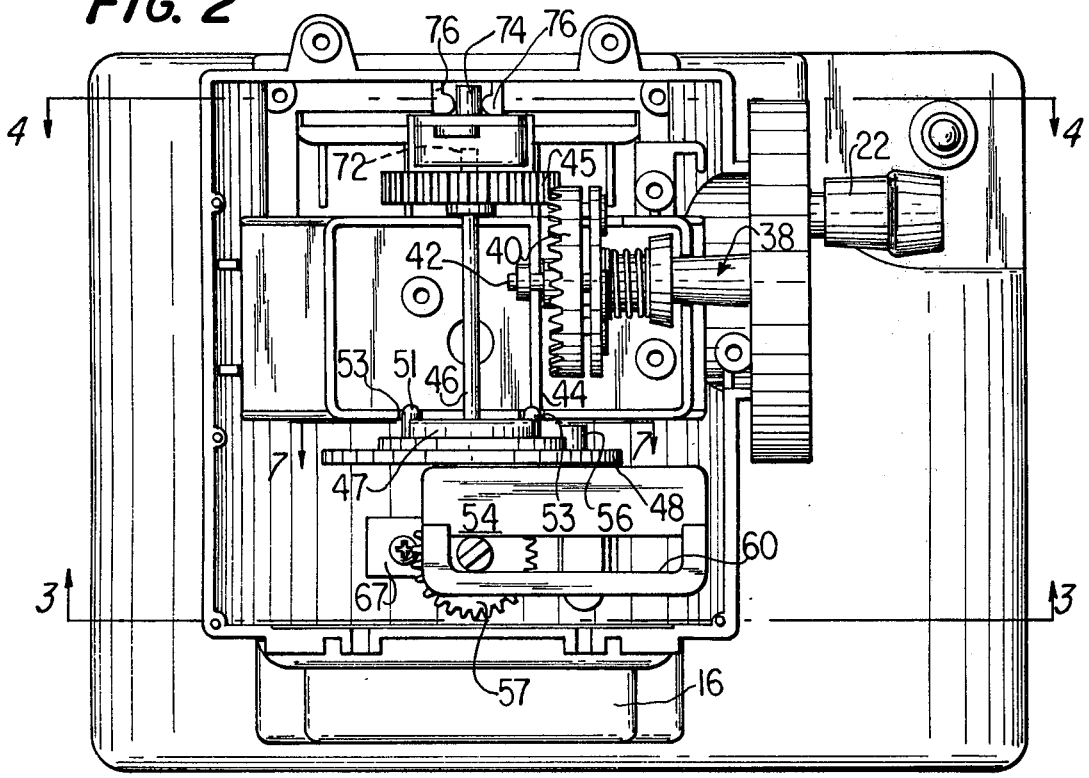
FIG. 2 is a top plan view of the knitting machine with a portion of the head thereof removed so as to expose the internal working mechanisms, including in particular the needle that is mounted to both reciprocate and rotate and the oscillating feed mechanism.
Figure 5:
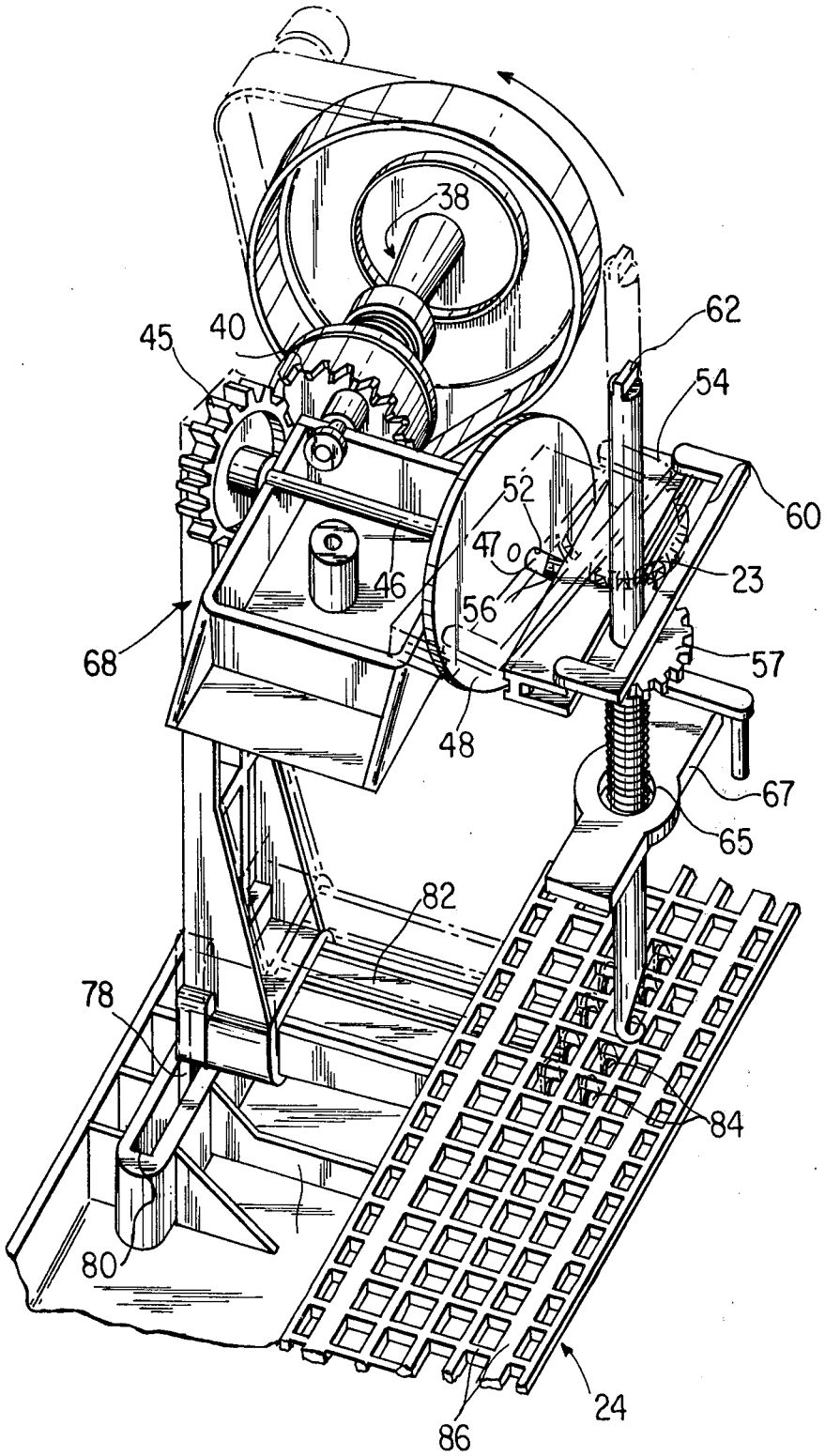
FIG. 5 is a perspective view of the top knitting device with the head and support section removed so as to illustrate in detail the arrangement and mode of operation of the needle and the feed mechanism.

As illustrated in FIG. 2, the handle 22 is part of the turning mechanism 38 which is suitably mounted to the head 14 for rotation. A crown gear 40 is mounted to one end of the turning mechanism 38 with the shaft 42 which has one end thereof journalled for rotation with respect to the chassis 44 within which certain of the operating components are mounted, and which is appropriately attached to the head 14. If desired, a clutch mechanism may be employed between the shaft 42 and the turning mechanism 38 so as to permit the turning mechanism 38 to rotate freely without transmitting such rotation to the shaft 42 under conditions of undesirable interference. The crown gear 40 meshes with the gear wheel 45 which is fixedly secured to a shaft 46 which is journalled for rotation with respect to the chassis 44. A circular disc 48 is also secured to the shaft 46. In this manner, it will be apparent that as the child rotates the handle 22 the crown gear 40 rotates in turn causing both the gear wheel 45 and the circular disc 48 to rotate. As illustrated in FIG. 5, the disc 48 is provided with a radially extending slot 52.

As illustrated in FIGS. 2 and 7, a plate 47, provided with a peripheral edge 67 of circular cross section and a cut-out cam surface 49, has two rods 51 which are positioned within openings 53 provided within a wall of the chassis 44, and an opening 55 through which the shaft 46 extends. It will be apparent that while the disc 48 rotates the plate 47 remains stationary, and that as the slot 52 of the disc 48 rotates through the area of the cut-out cam surface 49 the effective exposed area of the slot 52 increases, the purpose of which will be described hereinafter.

The elongated needle 23 is mounted to a bar 54 which is provided at one side thereof with a leg 56 which extends through the slot 52 of the disc 48, as illustrated in FIGS. 2 and 7. More particularly, the needle 23 is fixedly secured to a gear 57 which meshes with a continuous rack of teeth 58 formed along the inner surface of the bar 54, as illustrated in FIG. 3.

It will be apparent from FIGS. 2 and 5 that the bar 54 is provided with a slot 60 through which the needle 23 extends. The upper portion 62 of the needle 23 is loosely mounted within a cavity formed within the raised top 66 of the head 14, as illustrated in FIGS. 1 and 3, while the lower portion 63 of the needle 23 is loosely mounted within an opening 65 formed within a plate 67 which is secured to the wall of the support section 12, as illustrated in FIGS. 2–3. In this manner, the needle 23 is mounted to reciprocate along an axis defined by the opening 26 within the platform 16 of the base 10. It will also be apparent that the needle 23 may rotate about the aforementioned axis as a result of the gear 57 meshing with and moving along the rack of teeth 58 formed along the bar 54. The aforementioned reciprocation and rotation, as will be explained hereinafter, results from the spoke 56 which extends from the bar 54 following the circular path defined by the outer periphery 67 of the plate 47 and the cut-out cam surface 49.

Figure 4:
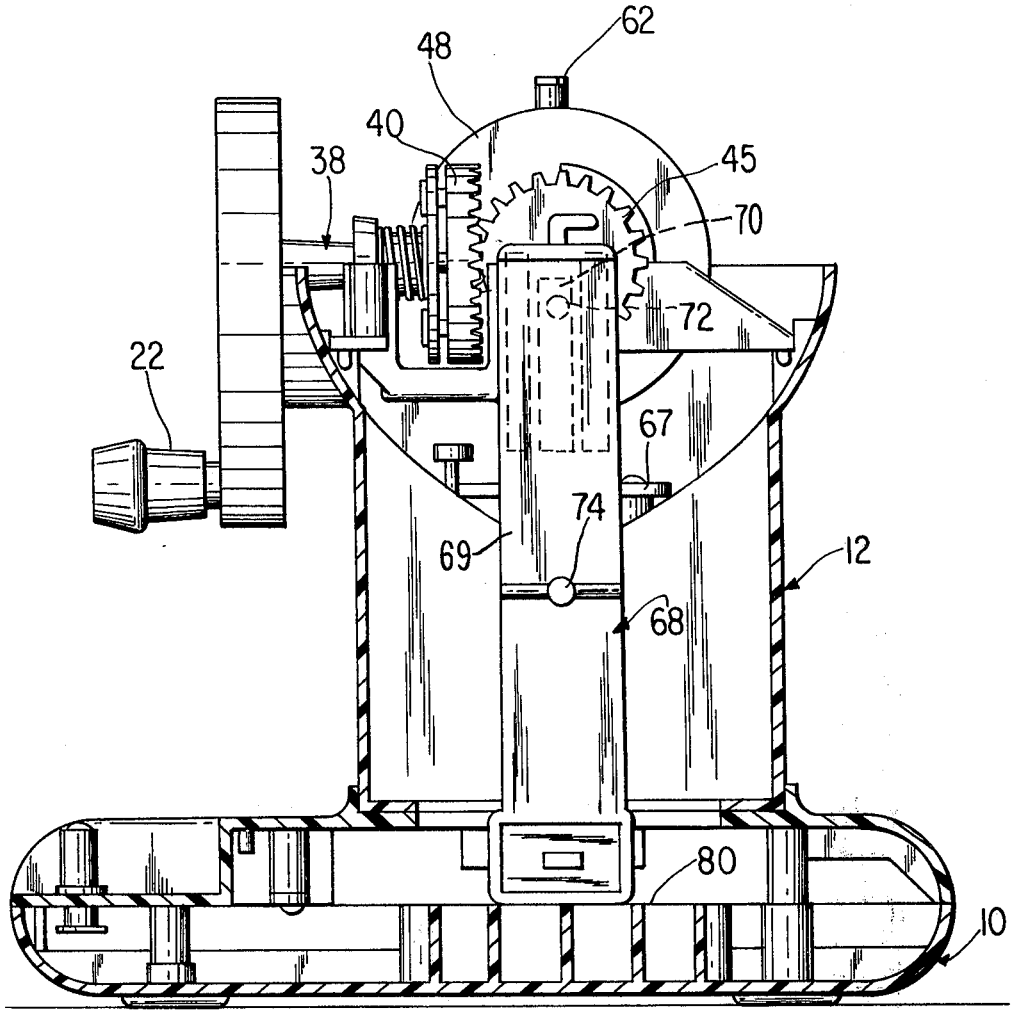
FIG. 4 is a sectional view taken along line 4—4 of FIG. 2 illustrating in particular the structural relationship of the oscillating feed mechanism and the rotating handle of the toy knitting device.

The leg 69 of advancing mechanism 68, as illustrated in FIGS. 4–5, is provided with a compartment 70 within which the spoke 72 which extends from the gear wheel 45 is positioned. The advancing mechanism 68, as illustrated in FIG. 2, is also provided with a stem 74 which is positioned between guide rails 76 which are formed within one wall of the support section 12. The bottom of the advancing mechanism 68 is provided with a flange 78 which extends downwardly into an open channel 80 formed within the base 10, and an outstanding arm 82 which terminates in two rows of upstanding teeth 84 which, as illustrated in FIGS. 5–6, are arranged to extend upwardly through the slots 28 formed within the platform 16 of the base 10. It will be apparent from the foregoing that as the child rotates the handle 22 the crown gear 40 rotates the gear wheel 45 and the stem 72 extending outwardly therefrom into the compartment 70 causes the advancing mechanism 68 to move back and forth, as illustrated in FIG. 5, during which time the stem 74 is free to slide between the rails 76, the result of which is to cause the two rows of teeth 84 to oscillate, the upward movement of the teeth 84 gripping the filaments 86 of the knitting frame 24 so as to advance the frame 24 a distance corresponding to one filament. It is to be understood, of course, that since the gear wheel 45 and the circular disc 48 rotate simultaneously, the reciprocating/rotating action of the needle 20 is synchronized with the oscillating motion of the advancing mechanism 68.

Figure 9:
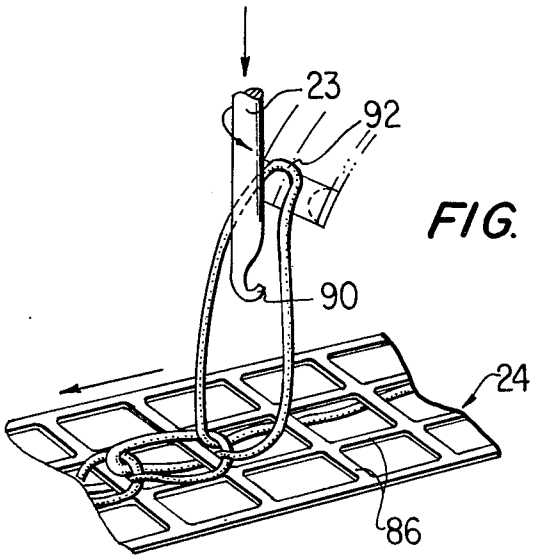
FIG. 9 is a perspective view illustrating the needle rotating and moving downwardly through the so-formed loop.
Figure 11:
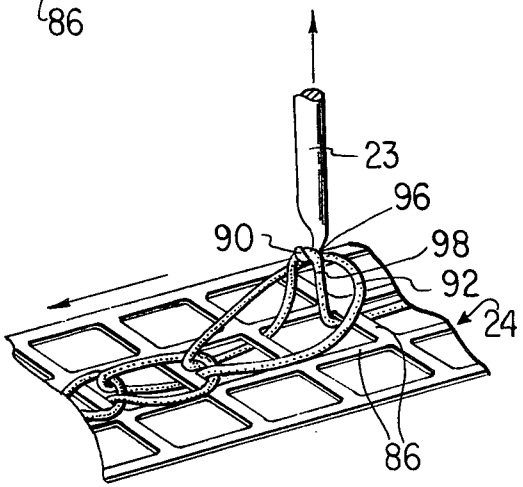
FIG. 11 is a perspective view illustrating the needle moving upwardly to hook a new loop.
Figure 10:
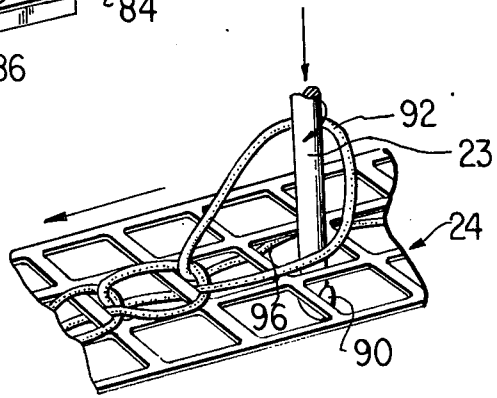
FIG. 10 is a perspective view illustrating the needle in its lowermost position.
Figure 8:
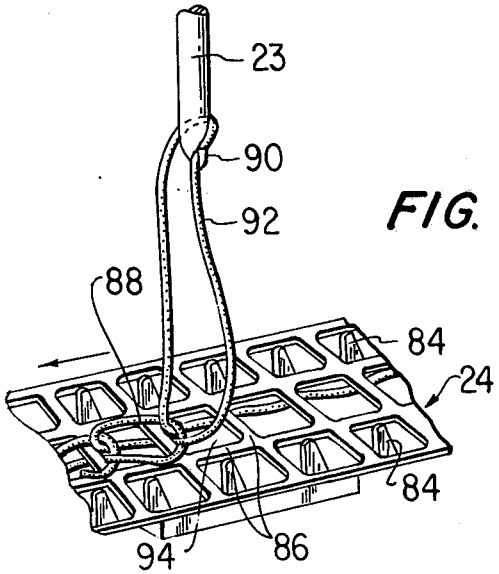
FIG. 8 is a perspective view illustrating the needle at its uppermost position in the knitting cycle wherein a loop of yarn is extended upwardly.

The knitting operation will now be described with reference to FIGS. 8–11 wherein it will be apparent that yarn 88 is being looped around the filament 86 of the knitting frame 24 with the use of the hook-end 90 of the needle 23. FIG. 8 illustrates the position of the needle 23 in its uppermost position after having pulled a loop 92 of the yarn 88 through the opening 94 defined by the adjacent filaments 86. Thereafter, the needle 23 is lowered, as illustrated in FIG. 9, and simultaneously rotated, so as to leave the loop 92 suspended, it being noted that the loop 92 will no doubt collapse to some extent. The needle 23 continues to move downwardly to its lowermost position illustrated in FIG. 10 and thereafter begins to move upwardly at which time the hook-end 90 engages the generally horizontally positioned portion 96 of the yarn 88 and thereafter moves upwardly, as illustrated in FIG. 11, through the previously formed loop 92 to form the next loop 98, after which the cycle is repeated. It is to be understood that the hook-end 90 of the needle 23 is rotated on two separate occasions, as previously described, and moreover that during that part of the cycle wherein the needle 23 is being raised, as illustrated in FIGS. 8 and 11, the advancing mechanism 68 is operable to advance the flexible plastic knitting framework 24 one increment defined as the space between longitudinally disposed, adjacent filaments 86. It will also be apparent that the knitting machine of the present invention operates to loop the yarn 88 about one row of filaments 86, as illustrated in FIGS. 8–11. But by urging the guide member 18 along the platform 16, as described above with reference to FIG. 6, it is possible to position a different strip of filaments 86 directly about the opening 26 within the platform 16 so that the yarn 88 may be looped about another row of the filaments 86.

I claim:

1. An amusement device for attaching yarn to a frame, comprising a housing provided with a platform, a handle, means mounting said handle to said housing for rotation, an advancing mechanism provided with means for gripping the frame, means operatively connecting said handle and said advancing mechanism for moving said gripping means in and out of engagement with the frame to advance same along said platform, a needle provided with means for gripping the yarn, and means operatively connecting said handle and said needle for rotating and reciprocating said needle in a predetermined sequence so as to progressively attach the yarn to the frame.

2. An amusement device as in claim 1, wherein said means operatively connecting said handle and said needle for rotating and reciprocating said needle comprise a disc mounted to rotate within said housing, means connecting said handle and said disc such that the movement of the handle rotates said disc, said disc being provided with a slotted portion extending in a generally radial direction, a bar provided with a rack of teeth and an elongated opening through which said needle extends, a gear fixed to said needle and engaging said rack of said bar, said bar also being provided with a stem extending within said slot of said disc, and cam means adjacent said disc for varying the position of said stem in said slot of said disc during rotation of said disc.

3. An amusement device as in claim 1, wherein said advancing mechanism comprises a leg, means mounting said leg to oscillate within said housing, and wherein said gripping means comprises two rows of teeth.

4. An amusement device as in claim 3, wherein said means operatively connecting said handle and said advancing mechanism comprises a gear mounted to rotate within said housing, and means operatively connecting said handle and said gear such that movement of said handle causes said gear to rotate, and means operatively connecting said leg of said advancing mechanism to said gear at a point offset from the center of rotation of said gear.

5. An amusement device as in claim 4, wherein said means connecting said handle and said gear comprises a crown gear and means mounting said crown gear to said handle, said crown gear meshing with said gear.

6. An amusement device as in claim 1, wherein said platform is provided with an opening positioned along the axis of reciprocation of said needle such that said gripping means of said needle may extend below the surface of said platform, a guide, said guide being provided with means permitting the frame to which the yarn is to be attached to move in a longitudinal direction, at least one opening provided in the guide through which said needle extends, and means mounting said guide to move transversely through a plurality of distinct positions with respect to said platform such that said gripping means of said needle may secure the yarn to said frame in different rows across the width thereof.

7. A top knitting device, comprising a frame to which the yarn is to be attached having a plurality of intersecting longitudinal and transverse portions defining a grid, and a machine for attaching the yarn to the frame having a housing provided with a platform, an opening in the platform, a needle mounted to the housing and terminating downwardly in a hook, needle movement means for reciprocating said needle such that said hook thereof moves in an out of said opening in said platform and rotating said needle in a predetermined manner, and advancing means coordinated with said needle movement means for advancing said frame longitudinally along said platform in increments corresponding to the space between adjacent of said transverse portions defining said grid.

8. An amusement device as in claim 7, including means for moving said frame transversely across said platform in increments corresponding to the space between adjacent of said longitudinal portions of said grid.

* * * * *